United States Patent [19]

Terry et al.

[11] Patent Number: 4,751,887

[45] Date of Patent: Jun. 21, 1988

[54] TREATMENT OF OIL FIELD WASTES

[75] Inventors: Edwin G. B. Terry; Larry K. Seedall, both of Houston, Tex.

[73] Assignee: Environmental Pyrogenics Services, Inc., Houston, Tex.

[21] Appl. No.: 96,894

[22] Filed: Sep. 15, 1987

[51] Int. Cl.[4] ..... A47J 36/00; A47J 36/24

[52] U.S. Cl. ..... 110/246; 110/211; 110/215; 110/216; 110/346; 110/236

[58] Field of Search ..... 110/246, 236, 346, 215, 110/216, 210, 211

[56] References Cited

U.S. PATENT DOCUMENTS

| | | | |
|---|---|---|---|
| 3,658,015 | 4/1972 | Griffin . | |
| 4,139,462 | 2/1979 | Sample, Jr. . | |
| 4,209,381 | 6/1980 | Kelly, Jr. . | |
| 4,222,988 | 9/1980 | Barthel . | |
| 4,361,100 | 11/1982 | Hinger | 110/246 X |
| 4,571,175 | 2/1986 | Bogle et al. | 110/238 X |
| 4,575,336 | 3/1986 | Mudd . | |
| 4,648,333 | 3/1987 | Mudd et al. . | |
| 4,704,972 | 11/1987 | Marchand | 110/216 X |
| 4,708,641 | 11/1987 | Meininger | 110/246 X |

*Primary Examiner*—Edward G. Favors

*Attorney, Agent, or Firm*—Pravel, Gambrell, Hewitt, Kimball & Krieger

[57] ABSTRACT

A method and apparatus of treating oil field wastes and particularly spent drilling fluids which contain barite and hydrocarbons which includes placing the drilling fluids into the upper end of a downwardly directed rotating kiln. Fuel and pressurized air are inserted into a furnace connected to the upper end of the kiln for supplying a fire to the drilling fluids in the kiln for igniting and burning the hydrocarbons in the drilling fluids as fuel until the drilling fluid is dry. Entrained particulates in the gas stream leaving the kiln are separated in a cyclone separator. The gases leaving the cyclone separator are passed through a secondary combustion unit to assure complete combustion of pyrolized carbonaceous residuals in the gas stream. The gases are then cooled in a heat exchanger and sent to a hydrosonic scrubber which removes the remaining particulates as well as oxides of sulfur. The gases are transported to a vent stack by use of a suction blower which produces the gas flow in the gas handling separation system. The liquids used in the hydrosonic scrubber are processed through a filter system to remove any particulates entrained therein. The solids dropping from the lower end of the kiln are environmentally stable and are then usable as landfill or road bed fill materials.

26 Claims, 1 Drawing Sheet

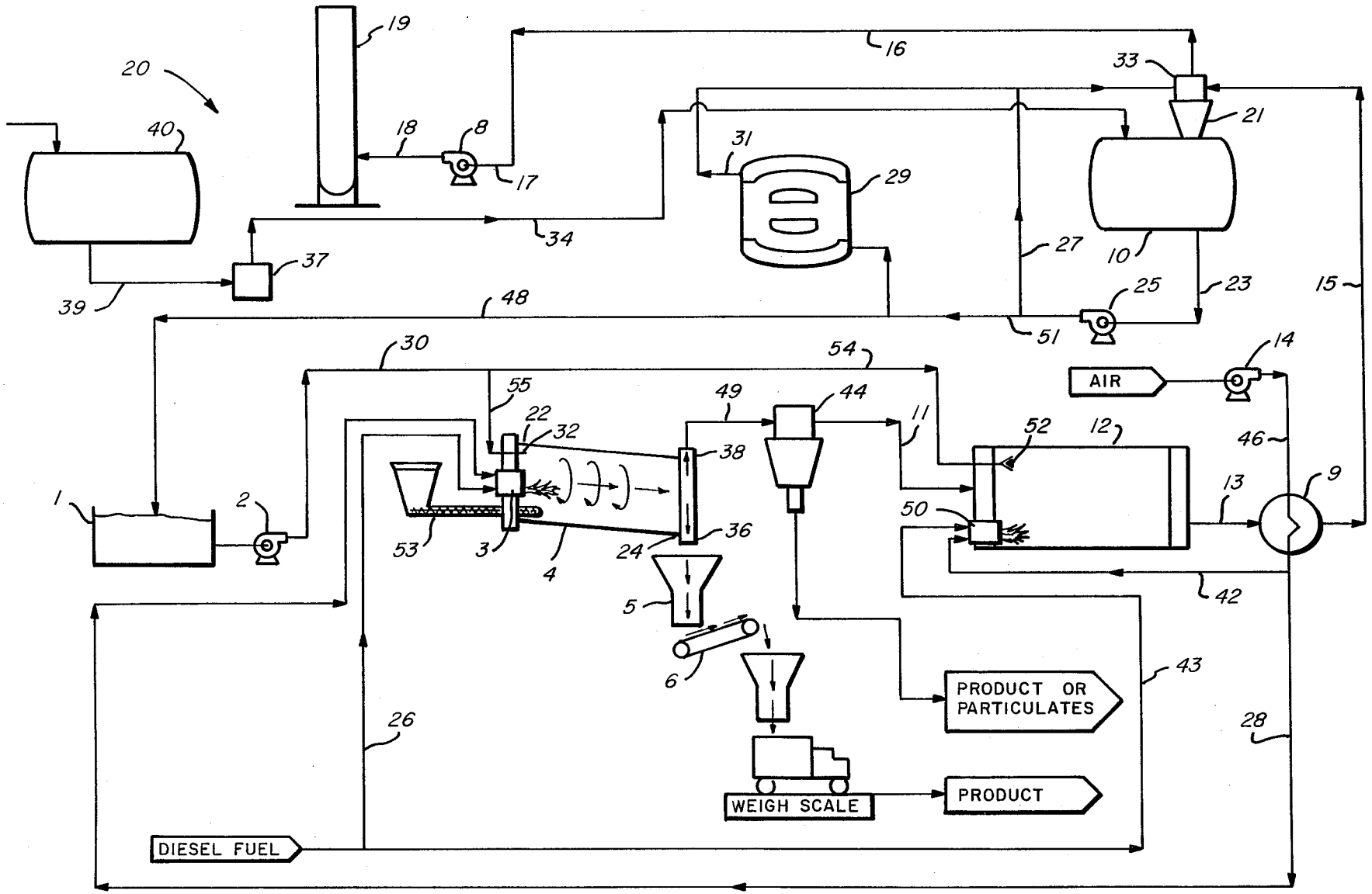
AIR
PRODUCT OR PARTICULATES
PRODUCT
WEIGH SCALE
DIESEL FUEL

TREATMENT OF OIL FIELD WASTES

BACKGROUND OF THE INVENTION

1. Field of Invention:

The present invention relates to treatment of oil field wastes.

2. Description of Prior Art:

Various oil field wastes contain hydrocarbons. However, various state and federal laws and regulations require that these wastes be properly disposed of. The disposal problem has been considerable and expensive. For example, it is conventional in rotary drilling oil and gas wells to use a drilling fluid commonly known as "mud." The drilling fluid performs various important functions as it is circulated downwardly through a drill pipe, out a drill bit and up the borehole to the surface. The drilling fluids commonly are of an oil base. In addition, the drilling fluids and the well cuttings may be exposed to hydrocarbons and other pollutants in the well bore.

Various methods and apparatus have been proposed to treat these oil field wastes in order to make them ecologically acceptable such as disclosed in U.S. Pat. Nos. 3,658,015; 4,209,381; 4,222,988; and 4,139,462. However, the problem of meeting all of the restrictions of governmental authorities and properly disposing of these oil field wastes has continued to be a difficult and expensive operation. U.S. Pat. Nos. 4,575,336 and 4,648,333, owned by the assignee of the present application, offered improvements over the prior art methods of oil field waste treatment. However, it has been found by applicants that the techniques of these patents presented the possibility of particulate matter escaping into the atmosphere. One group of components in the waste combustion gases which might escape was the oxides of sulfur, while another was pyrolized carbonaceous residuals.

SUMMARY OF THE INVENTION

Briefly, the present invention offers improvements over the techniques of U.S. Pat. Nos. 4,575,336 and 4,648,333, directed to improved methods and apparatus for treating oil field wastes and particularly spent drilling fluids and cuttings which contain hydrocarbons. Hydrocarbons in the oil field wastes are used as a supplementary source of fuel for burning the wastes to provide a pollution-free residue and to recover and recycle the constituents. The process thus avoids the disposal problem and provides products for resale, thereby reducing the cost of the treating process.

The present invention involves the treatment and disposal of wastes containing carbonaceous materials by igniting and burning the carbonaceous materials material in a rotary kiln as supplemental fuel. The residual materials leaving the lower end of the rotary kiln are environmentally stable materials. The present invention is directed more particularly to a method and apparatus for treating oil field wastes containing hydrocarbons, more particularly non-hazardous oil field wáste such as spent drilling fluids. The present invention recycles spent oil field drilling fluids containing valuable constituents such as barite and clays by recovering them from less valuable constituents.

Generally, the invention comprises a method and apparatus for recycling used oil field drilling fluids containing barite and hydrocarbons wherein the used drilling fluids are placed in the upper end of a downwardly directed rotating kiln, with fuel and combustion air inserted into the kiln at the same end of the kiln at which the drilling fluids are inserted. The fuel and air aid in starting and maintaining combustion of the hydrocarbons in the fluid, materially aiding in reducing the risk of uncontrolled explosion of the hydrocarbons in the oil field waste during the oxidation process.

Combustion products leave the kiln at outlets at the second end of the kiln. High weight dried waste in the combustion products is separated at the second end of the kiln from the lighter combustion products by gravity. The high weight dried waste can then be used for such purposes as landfill. The lighter combustion products pass from the kiln outlet to a cyclone separator where barite and clays are separated from the combustion products. Downstream from the cyclone separator is a secondary combustion unit where residual pyrolized gases from oxidized carbonaceous waste from the kiln are burned. Exhaust gases from the secondary combustion unit then pass to a heat exchanger, preferably a gas cross exchanger, where they are cooled to a substantially 100% water saturation point with air which, after preheating in the heat exchanger, passes to the furnace for use as a combustion gas. The cooled output from the heat exchanger then passes to a separator where residual particulates and oxides of sulfur are removed prior to venting the exhaust gases to the atmosphere.

BRIEF DESCRIPTION OF THE DRAWINGS

The sole FIGURE is a schematic flow diagram of the present invention.

DESCRIPTION OF THE PREFERRED EMBODIMENT

Drilling fluids used in rotary drilling oil and gas wells perform various important functions. The major constituent of a drilling fluid is barite, which adds weight to the mixture. Other components may include oil, water, clays and various chemical additives which perform various functions such as corrosion control, lubrication and viscosity control. However, the disposal of oil base spent drilling fluids and drill cuttings has created costly disposal problems and pollution problems with possible consequent liabilities many years later. The present method and apparatus provides a way for treating and disposing of the oil field waste which contain hydrocarbons to convert them into a pollution-free product. In addition, the present method and apparatus reclaims the constituents from the spent drilling fluids, thereby not only eliminating costly disposal expenditures but permitting recycling of the spent drilling fluids.

The major component of drilling mud is barium sulfate ($BaSO_4$), commonly known as "barite." The specific gravity of barite is generally about 4.3 to about 4.6. The present method and apparatus recovers and recycles the barite and clays in the spent drilling fluid and provides a valuable recycled drilling fluid. In addition, the other components of the drilling fluids are rendered pollution-free and, while less valuable, can be sold for other uses.

Referring now to the drawing, an apparatus suitable for practicing the present invention is generally indicated by the reference numeral 20. Conventional valves and valve controls are not shown in the drawing to more clearly illustrate the present invention. A holding tank 1 is provided for receiving liquid carbonaceous waste such as spent drilling fluids and drill site slopes pit liquids. These liquids are stored in holding tank 1 prior to processing. The carbonaceous waste, i.e., spent drilling fluids, may include oil, barite, trash, water, entrained solids, and various chemicals. This liquid waste can then be pumped through line 30 to line 55 then into a rotary kiln 4 at an inlet 32 which is provided for receiving carbonaceous fluids with a high solids content by volume. Liquid waste with a low solids content flows through line 54 and is injected through a spray nozzle 52 into the secondary combustion unit 12. The liquid waste injected or sprayed into the rotary kiln 4 or secondary combustion unit 12 is exposed to sufficiently high temperatures to oxidize the carbonaceous constituents and reduce the residue to a non-polluting form. In order to initiate the combustion of the carbonaceous waste while in the rotary kiln 4, a horizontal kiln burner 3 is provided at a first or inlet end 22 of the kiln 4. The first end 22 is preferably at a higher elevation than a second or outlet end 24 of the kiln 4. The kiln 4 is equipped with a burner 3 such as a COEN conventional kiln burner and utilizes a suitable fuel, such as diesel, supplied by line 26 to the inlet of the burner 3. Carbonaceous bearing waste such as drill cuttings or slopes pit bottoms can be fed into the kiln 4 via a volumetric multi-screw conveyor 53.

Air for combustion with the fuel is supplied by an air blower 14 to line 46 to an inlet of a heat exchanger, preferably a gas cross exchanger, 9 for preheating of the combustion air. The preheated combustion air from the gas cross exchanger 9 flows through a line 28 to the inlet of the burner 3. The burner 3 is used to initiate combustion of the drilling fluids in the kiln 4 and to aid combustion of the drilling fluid. After startup, the carbonaceous content of the drilling fluids is used to supplement combustion, thereby saving fuel as well as disposing of the undesirable carbonaceous components in the drilling fluid.

The drilling fluids are conveyed to the kiln 4 from the holding tank or pit 1 by suitable means such as a slurry pump 2 which withdraws the stored drilling fluids from the holding tank 1 through a line 30 to a feeder 32 above the heater 3 to deposit the spent drilling fluids into the first end 22 of the kiln 4.

The kiln 4 rotates on a trunion and thrust rolls as it is driven by a drive assembly. The kiln 4 is lined internally with a suitable refractory material such as a CERRAM castable refractory manufactured by C-E REFRACTORIES, which aids in maintaining an even heat gradient through the kiln 4, thereby maximizing the combustion destructive efficiency ratio. In one embodiment, the kiln is about 6'4" (1.93 meters) in diameter and 60' (18 meters) long.

It should be noted that both the processed drilling fluids and the heated gasses from the furnace 3 flow the same direction through the kiln 4 to provide concurrent flow. This insures that all of the burnable material in the incoming spent drilling fluids is immediately exposed to flame when it enters the first end 22 and is ignited as it encounters the flame. By immediately igniting the incoming fluid, the possibility of an explosion is reduced or eliminated. A countercurrent flow of heat relative to the flow of drilling fluids would tend to generate a volume of explosive gases in the kiln 4 and cause the possibility of dangerous explosion. The temperature in the kiln 4 is critical to obtain an environmentally acceptable destructive efficiency ratio of the carbonaceous components in the oil field waste.

The desired operating temperature of the kiln 4 is between 1600° F. and 2400° F. The operating temperature is dependent on the carbonaceous constituents in the waste. This temperature is well below the melting point of barite (2876° F.). Combustible materials are fully oxidized but non-combustibles, such as drill bit pieces, shells, sand and shale and so forth, are conveyed to the outlet end 24 for combustion waste products of the kiln 4. The outlet end 24 of the kiln 4 includes a lower outlet 36 through which the heavier non-combustible residual materials of the combustion wastes falls by gravity into a wet hopper 5 which feeds a bucket elevator 6 which conveys the residues, which are now environmentally safe, to a truck. These residues may be sold for various uses, such as a landfill.

An upper outlet 38 for lighter residues of the combustion wastes is connected to a line 49 which permits flow to a high efficiency cyclone separator 44 where a majority of the entrained fines of the combustion wastes, which include barite and clays, are separated from the gas stream. The gas stream leaving the cyclone separator 44 flows through a suction line 11 to a secondary combustion unit 12, where the combustion waste gases, which may contain some residual carbonaceous pyrolized gases, are combusted.

The secondary combustion unit 12 operates at a temperature range of 1800° F. to 2600° F. The operating temperature is dependent on the carbonaceous constituents in the liquid waste sprayed into the secondary combustion unit 12 and/or the constituents in the waste stream from the kiln 4. The secondary combustion unit 12 is fired using a conventional burner 50 which receives fuel from an inlet line 43. The preheated air used to assist combustion in the secondary combustion unit is supplied from inlet line 42.

Gases flow from the secondary combustion unit 12 through a line 13 to the gas cross exchanger 9. The combustion gases are there cooled to a 100% water vapor saturation temperature of the gases. From there, the vapor saturated gases flow through a line 15 to a hydrosonic cyclone 21. In the hydrosonic cyclone 21, the gases are contacted with a liquid solution to strip the remaining entrained particulates as well as oxides of sulfur from the gaseous combustion wastes.

The contaminated liquid solution containing the stripped particulates and oxides of sulfur leaves the hydrosonic cyclone 21 and is stored in a scrubber tank 10. The contaminated liquids flow from the scrubber tank 10 into a circulation pump inlet line 23 to the circulation pump 25. The liquid leaving the circulation pump 25 enters line 51 to a liquids filter 29, where the entrained particulates in the liquid are removed. The filtered liquids leave the liquid filter 29 through line 31 and flow to a hydrosonic cyclone inlet line 33. When there is a significant pressure gradient across the filter, the filter is taken out of service and the liquids flow from line 51 to bypass line 27. This bypass flow occurs until the filter elements are cleaned. The fluids flowing through bypass line 27 flow to the hydrosonic cyclone inlet line 33 on the hydrosonic cyclone 21.

When the liquid solution has been sufficiently polluted with oxides of sulfur, the liquids are cycled from the circulation pump 25 through line 51 to the tank recycle line 48 to the feed tank 1. New liquid solution is supplied from storage tank 40 through line 39 to a reciprocating feed pump 37. The liquid solution leaves the reciprocating feed pump 37 and enters line 34. The liquid solution flows from line 34 to the scrubber tank 10.

The cleaned gases leaving the hydrosonic cyclone 21 enter line 16 and flow to suction blower inlet line 17. The cleaned gases flow through line 17 to the suction blower 8 where they are exhausted through line 18 to vent stack 19 into the atmosphere.

The operation of the present invention is apparent from the foregoing description of the preferred embodiment of the invention. It includes disposing of oil field wastes containing hydrocarbons by igniting the waste in the rotary kiln 4, burning the waste and using the hydrocarbons in the kiln 4. The method further comprehends inserting fuel and air into the kiln 4 for starting and aiding combustion of carbonaceous wastes. The method further comprehends separating the dry fines from the effluent gas in the cyclone separator 44, burning any residual carbonaceous pyrolized gases in the secondary combustion unit 12, cooling the effluent gas to a substantially 100% water saturation point in gas cross exchanger 9, and cleaning the cooled gas in hydrosonic cyclone 21 prior to exhaust to the atmosphere. The method also comprehends placing the carbonaceous waste, such as spent drilling fluids, into the upper end of a downwardly directed rotating kiln 4 and using a burner 3, utilizing a fuel such as diesel, at the same end of the kiln 4 for starting and aiding combustion of the carbonaceous constituents in the waste in the kiln.

The foregoing disclosure and description of the invention are illustrative and explanatory thereof, and various changes in the size, shape and materials, as well as in the details of the illustrated construction may be made without departing from the spirit of the invention.

What is claimed is:

1. An apparatus for recovery of barite and clays from spent drilling fluids comprising:

(a) a rotary kiln having a first end higher than a second end whereby drilling fluids therein will flow from the first end to the second end, said kiln having an inlet at the first end for receiving drilling fluids and combustion air;

(b) a burner connected to the first end of the kiln for supplying fire to the kiln for aiding in burning the combustible components of the drilling fluids in the kiln;

(c) a fuel and pressurized air inlet connected to said burner;

(d) an outlet at the second end of the kiln for removing the light weight waste;

(e) means connected to the outlet for removing high weight dried waste from the kiln by gravity;

(f) cyclone separator means located downstream of said kiln outlet for separation of particulates such as barite and clays;

(g) secondary combustion means located downstream from said cyclone separator means for oxidation of residual pyrolized gases from oxidized carbonaceous waste from the kiln;

(h) heat exchanger means for cooling the exhaust gases to substantially a 100% water saturation point with incoming combustion air to preheat the combustion air; and (i) means for removing residual oxides of sulfur from the exhaust gases prior to venting to the atmosphere.

2. The apparatus of claim 1, further including:

means for conveying the preheated combustion air from said heat exchanger means to said burner.

3. The apparatus of claim 1, wherein said means for removing residual oxides of sulfur comprising:

a hydrosonic cyclone for stripping the oxides of sulfur from the gaseous combustion wastes with a liquid solution.

4. The apparatus of claim 3, further including:

means for storing the stripped oxides of sulfur as a contaminated liquid solution.

5. The apparatus of claim 4, further including:

means for filtering the contaminated liquid solution.

6. The apparatus of claim 5, further including:

means for bypassing said means for filtering the contaminated liquid solution.

7. The apparatus of claim 4, further including:

(a) a holding tank for receiving the drilling fluids for provision to said rotary kiln; and (b) means for cycling the contaminated liquid solution to said holding tank.

8. An apparatus for treating wastes containing carbonaceous materials, comprising:

(a) a rotary kiln having a first end higher than a second end whereby material rotating therein will flow from the first end to the second end, said kiln having an inlet at the first end and outlet means at the second end;

(b) means for injecting burning fuel and air into said first end of said kiln to cause substantially complete combustion of the carbonaceous materials in the wastes to leave only dry, solid, non-combustible residue gases;

(c) separating means connected to said outlet means for separating heavier solid materials exiting said kiln from lighter materials exiting said kiln, said separating means including suction means for entraining the lighter materials in the residue and gases from said kiln while permitting heavier solid materials to separate from the residue and gases by gravity;

(d) means downstream from said kiln for separating particulates in the gas stream before it is furnished to a secondary combustion unit for substantially complete oxidation;

(e) means downstream of said separating means for combustion of pyrolized gases resulting from oxidation of the carbonaceous materials in said kiln;

(f) means for cooling exhaust gases leaving said means for combustion of pyrolized gases to a water vapor saturation point; and (g) means downstream of said means for cooling for scrubbing particulates and oxides of sulfur from the exhaust gases prior to venting to the atmosphere.

9. The apparatus of claim 8, further including:

said means for cooling including heat exchanger means for preheating the combustion air; and means for conveying the preheated combustion air from said heat exchanger means to said means for injecting.

10. The apparatus of claim 8, further including:

a hydrosonic cyclone for stripping the oxides of sulfur from the gaseous combustion wastes with a liquid solution.

11. The apparatus of claim 10, further including:

means for storing the stripped oxides of sulfur as a contaminated liquid solution.

12. The apparatus of claim 11, further including:

means for filtering the contaminated liquid solution.

13. The apparatus of claim 12, further including:

means for bypassing said means for filtering the contaminated liquid solution.

14. The apparatus of claim 10, further including:

(a) a holding tank for receiving the drilling fluids for provision to said rotary kiln; and (b) means for cycling the contaminated liquid solution to said holding tank.

15. A method of recycling particulate matter from liquid waste containing carbonaceous materials, comprising the steps of:

(a) burning the carbonaceous waste to convert it into dried high weight product and gaseous effluent waste containing the particulate matter;

(b) removing the dried waste for recycling;

(c) separating the particulate matter from the gaseous waste for recycling;

(d) secondarily combusting the gaseous waste to burn any residual pyrolized gases from the oxidized carbonaceous material;

(e) cooling the combusted gaseous waste to a substantially 100% water saturation point; and (f) removing residual particulates and oxides of sulfur from the cooled gaseous waste so that it may be returned to the atmosphere.

16. The method of claim 15, further including the steps of:

preheating combustion air during said step of cooling; and conveying the preheated combustion air for use in said step of burning.

17. The method of claim 15, wherein said step of removing residual oxides of sulfur comprises:

stripping the oxides of sulfur from the gaseous combustion wastes with a liquid solution.

18. The method of claim 17, further including the step of:

storing the stripped oxides of sulfur as a contaminated liquid solution.

19. The method of claim 18, further including the step of:

filtering the contaminated liquid solution.

20. The method of claim 19, further including the steps of:

(a) receiving the drilling fluid in a storage tank prior to said step of burning; and (b) cycling the contaminated liquid solution to the receiving tank.

21. A method for recycling particulate matter from hydrocarbon-containing used drilling fluid and for disposing of the used drilling fluid, comprising the steps of:

(a) burning the used drilling fluid in a rotary kiln, using the hydrocarbons in the used drilling fluid as one of the sources of fuel, to convert the used drilling fluid into dried waste and gaseous waste containing the particulate matter;

(b) removing the dried waste from the rotary kiln for recycling;

(c) separating the particulate matter from the gaseous waste for recycling;

(d) secondarily combusting the gaseous waste to burn any residual pyrolized gas;

(e) cooling the combusted gaseous waste to a substantially 100% water saturation point; and (f) removing the residual particulates and oxides of sulfur from the cooled gaseous waste so that it may be returned to the atmosphere.

22. The method of claim 21, further including the steps of:

preheating combustion air during said step of cooling; and conveying the preheated combustion air for use in said step of burning.

23. The method of claim 21, wherein said step of removing residual oxides of sulfur comprises:

stripping the oxides of sulfur from the gaseous combustion wastes with a liquid solution.

24. The method of claim 23, further including the step of:

storing the stripped oxides of sulfur as a contaminated liquid solution.

25. The method of claim 24, further including the step of:

filtering the contaminated liquid solution.

26. The method of claim 25, further including the steps of:

(a) receiving the drilling fluid in a storage tank prior to said step of burning; and (b) cycling the contaminated liquid solution to the receiving tank.

* * * * *